United States Patent [19]

Hardy

[11] 4,224,563

[45] Sep. 23, 1980

[54] REGULATOR CIRCUIT FOR PHOTOGRAPHIC ILLUMINATION

[75] Inventor: Herbert L. Hardy, Sudbury, Mass.

[73] Assignee: Polaroid Corporation, Cambridge, Mass.

[21] Appl. No.: 938,767

[22] Filed: Sep. 1, 1978

[51] Int. Cl.[2] ..... G05F 1/60

[52] U.S. Cl. ..... 323/225 C; 323/21; 323/24; 323/34

[58] Field of Search ..... 323/19, 21, 22 R, 225 C, 323/24, 34, 35, 36; 307/252 F, 252 T, 297

[56] References Cited

U.S. PATENT DOCUMENTS

| | | | |
|---|---|---|---|
| 3,538,427 | 11/1970 | Oltendorf | 323/24 |
| 3,714,547 | 1/1973 | Ross, Jr. et al. | 323/24 |
| 3,947,754 | 3/1976 | Wechsler | 323/225 C |
| 3,952,241 | 4/1976 | Takemura et al. | 323/34 X |
| 3,952,242 | 4/1976 | Ukai | 323/24 X |
| 4,011,498 | 3/1977 | Hamstra | 323/21 |
| 4,028,613 | 6/1977 | Stiller et al. | 323/225 C X |

OTHER PUBLICATIONS

G. J. Granieri, "AC Voltage Regulators Using Thyristors", Application Note AN-3886, RCA Solid State Division.

R. J. Haver et al., "Theory, Characteristics and Applications of the PUT", Application Note AN-527, Motorola Semiconductor Products Inc.

D. Perkins, "True RMS Voltage Regulators", Application Note AN-509, Motorola Semiconductor Products Inc.

R. W. Fox, "Solid State Incandescent Lighting Control", Semiconductor Department of General Electric Corporation.

*Primary Examiner*—J. D. Miller

*Assistant Examiner*—Peter S. Wong

*Attorney, Agent, or Firm*—Edward S. Roman

[57] ABSTRACT

An electrical regulator for operating a photographic illuminating lamp provides two controls on the triggering of a phase-controlled power switch. One control employs a differential switch in a feed-forward loop that adjusts the potential at which a timing capacitor triggers the power switch. The other control is a feedback loop which controls the rate at which the timing capacitor is charged. The regulator combines the feedforward and feedback controls to regulate the mean square of the lamp voltage for a wide range of input voltage amplitudes and frequency.

9 Claims, 2 Drawing Figures

ALTERNATING LINE VOLTAGE
LAMP

LIGHT
REGULATOR
CAMERA

REGULATOR CIRCUIT FOR PHOTOGRAPHIC ILLUMINATION

BACKGROUND OF THE INVENTION

This invention relates to an electrical regulating circuit. In particular, it provides a regulating circuit for operating a photographic illuminating lamp with regulation of the lamp voltage over a wide range of variations in the amplitude and in the frequency of the input alternating line voltage.

A lamp for photographic illumination often is called upon to produce illumination of specified intensity and specified spectral characteristics in order to produce the desired photographic exposure. An electrical regulator is used to provide the desired stability of lamp voltage, and regulators are known which can accommodate variations in the amplitude or the frequency of the line voltage which powers the lamp. However, photographic illuminators are subject to use throughout the world, and hence are called upon to operate with different and fluctuating values of both voltage and frequency. To meet this requirement in the past has required separate adapters for use with different input powers, or that the operator change switch settings on the regulator.

Further, it is known, for example from the Optoelectronics Manual published by the Semiconductor Products Department of General Electric Corporation, to control the power applied to a lamp to maintain constant brightness over a range of supply voltages. One such circuit controls the charging of a triac-controlling timing capacitor in response to an opto-electric transducer that monitors the output light from the lamp being powered. Other prior publication regarding a. c. voltage regulators for use with lamps, and other devices, include Application Notes AN-509 and AN-527 of Motorolla Semiconductor Products, Inc; Application Notes AN-3886 of the Solid State Division of RCA; and Application Note 200.53 of the Semiconductor Products Department of General Electric. Inc.

U.S. Pat. Nos. 3,952,242 and 3,714,547 also disclose voltage regulators for use with lamps. The former patent regulates the charging of a triac-controlling timing capacitor in response to feedback produced by a lamp connected in parallel with the load and as sensed with an opto-electric transducer. The latter patent employs an operational amplifier to control the triggering of a triac.

However, the prior teachings fail to provide regulators capable of controlling the voltage applied to a lamp under the variations of both amplitude and frequency encountered in line voltages around the world. These line voltages typically range in value between 100 to 240 volts, and range in frequency between 50 and 60 Hertz.

Accordingly, it is an object of the present invention to provide a regulator having this capability. That is, it is an object of the invention to provide a voltage regulator for a photographic lamp suitable for use automatically with a line voltage having a frequency between 50 and 60 Hertz and an amplitude at least between 100 and 240 volts. Such a regulator will be suitable for use with many, if not all, line voltages encountered throughout the world.

It is a further object of the invention to provide a voltage regulator of the above character which is compact, which is relatively light in weight, and which is relatively low in cost. It is also an object that the regulator be safe for the operator to use with minimal risk of electrical shock from the line voltage.

A further object of the invention is that the voltage regulator sustain minimal damage in the event of failure of the lamp being powered, even short circuiting of the lamp.

It is also an object that the voltage regulator operate with high reliability, and correspondingly with relatively high freedom from response to spurious noise signals.

Other objects of the invention will in part be obvious and will in part appear hereinafter.

SUMMARY OF THE INVENTION

A voltage regulator according to the invention for operating a lamp for photographic illumination has both a feed-forward regulating loop responsive to the input line voltage, and a feedback regulating loop responsive to the voltage developed at the load. The circuit combines the two loops in a manner that regulates the mean square value of the lamp excitation voltage for a wide range of input voltage frequencies and amplitudes. More particularly the regulator maintains the means square, and hence the RMS value, of the lamp voltage substantially constant. One embodiment of the regulator maintains 90 volts RMS, plus or minus 10%, across the lamp with an input line voltage ranging in frequency between 50 and 60 Hertz and ranging in amplitude between 90 and 280 volts RMS.

One feature of the invention accordingly is the combination of the two modes of regulation, for both input frequency and amplitude, in a relatively simple, compact and low cost circuit. Another feature is that both modes of regulation control the operation of a single timing capacitor. The capacitor is charged from a voltage of relatively fixed value, and the feed-forward loop includes a differential semiconductor switch element which adjusts the potential at which the capacitor charge triggers the load-powering switch element. The feed-forward stage includes a further capacitor that augments low levels of control voltage at the differential switch to prevent false triggering. In addition, the feedback loop adjusts the rate at which the capacitor is charged from the supply of relatively fixed voltage. This stage employs a sensor of the mean square voltage at the load.

These and other features of the invention described herein result in a voltage regulator for powering a photographic illuminating lamp from alternating line voltage found essentially any where in the world. The regulation is sufficient to yield illumination of the same intensity and temperature, i.e., spectral characteristic, for reliable photographic illumination.

The invention accordingly comprises the features of construction, combination of elements, and arrangement of parts exemplified in the construction hereinafter set forth, and the claims indicate the scope of the invention.

BRIEF DESCRIPTION OF THE DRAWING

The objects, features and advantages of the invention will become more apparent from the following description of an illustrative embodiment, taken in conjunction with the accompanying drawing in which.

DESCRIPTION OF ILLUSTRATED EMBODIMENTS

Figure 1:
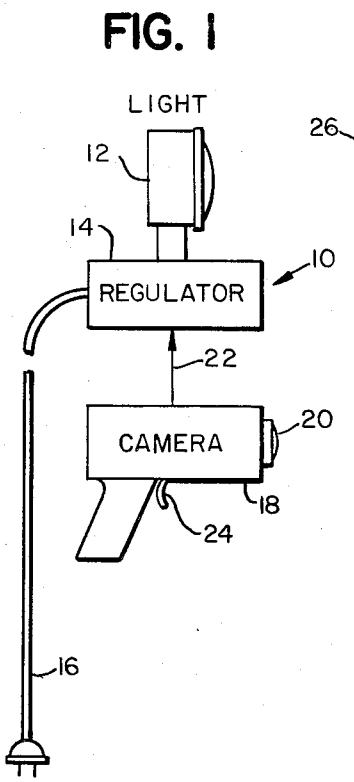
FIG. 1 is block schematic drawing of a photographic system employing a regulator according to the invention.

FIG. 1 illustrates conventional photographic illuminating equipment 10 which has a lamp 12 which a regulator 14 operates, either from batteries or, as illustrated, from external line voltage as applied to the regulator with a power cord 16. The externally-powered illuminating equipment is used with a camera 18, typically a movie camera. The regulator converts the available line power to the voltage which the lamp requires for the specified photographic exposure. The regulator and lamp conventionally are mounted on the camera to aim the lamp selectively relative to the camera lens 20. The regulator is turned on to provide illumination during film exposure, as initiated with a camera switch 24, by signals which an interconnecting cable 22 applies to it from the camera.

Figure 2:
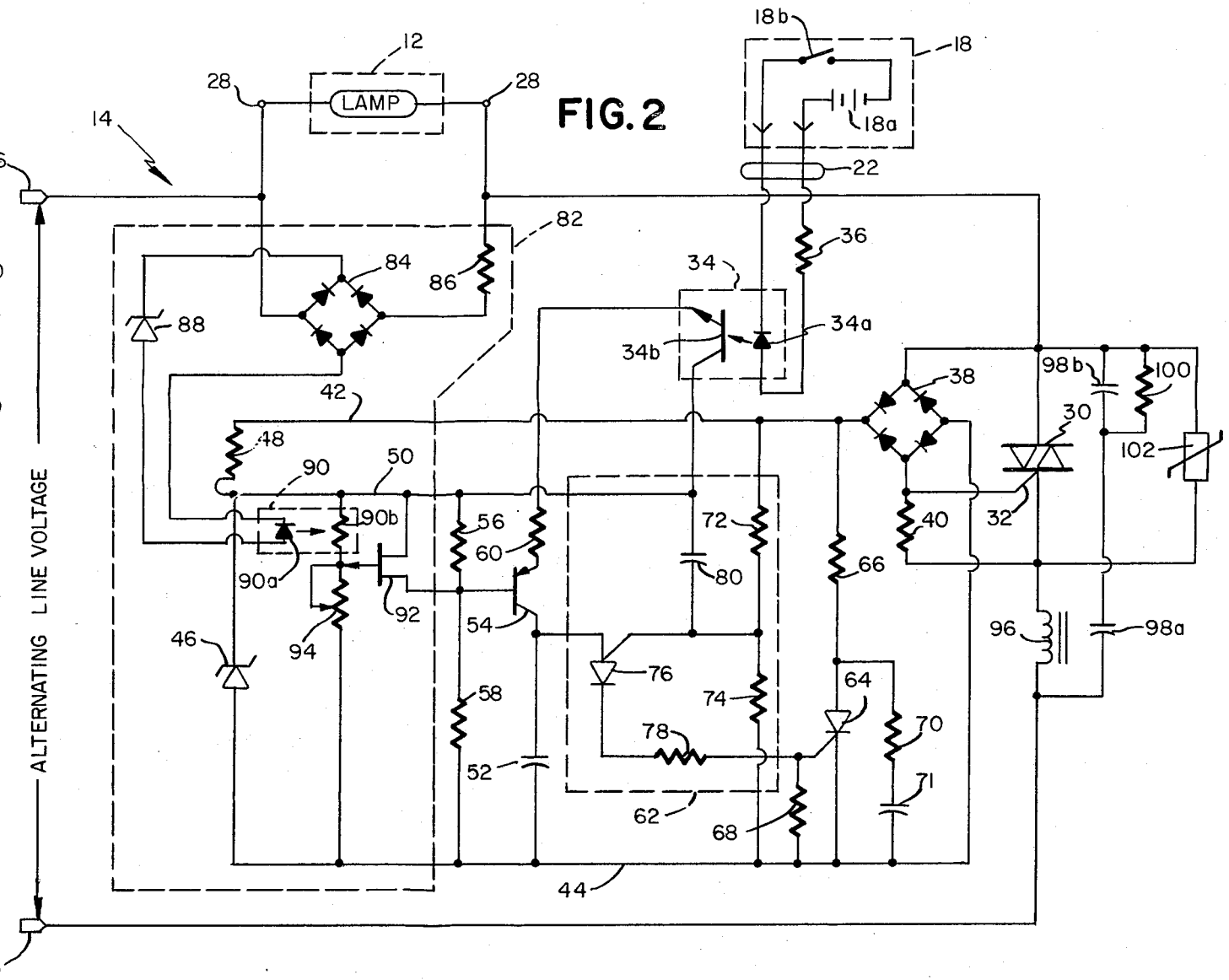
FIG. 2 is a circuit diagram of a regulator embodying the invention.

FIG. 2 shows the lamp regulator which the invention provides for use with line voltage of relatively widely varying amplitude and frequency. These variations include both differences in nominal values as occur in different locations, and variations of the nominal values with time. The regulator has a pair of input terminals 26 for connection to the line voltage. A pair of load terminals 28, to which the lamp 12 is connected, and a triac 30 are in series between the input terminals 26. The triac functions as a current-carrying switch that is normally nonconductive and can be switched, with a signal at the gate 32, to conduct current in either direction during different half-cycles of the alternating input voltage.

The interconnecting cable 22 connects, within the illustrated camera 18, to a direct voltage supply **18*a* through a normally-open series switch 18*b* that is closed upon closure of the camera switch 24. Within the regulator 14, the cable 22 applies the camera voltage to operate an isolating switch in the form of an opto-isolator 34, also known as a photocoupler, which is in series with a protective resistor 36. The illustrated opto-isolator 34 employs a light-emitting diode 34*a* as the input element and has a phototransistor 34*b* as the output element. Closure of the camera switch 18*b* applies current from the battery 18*a* to the light-emitting diode 34*a*, and the resultant emitted light switches the phototransistor 34*b* conductive, from a normally nonconductive state. When conductive, the phototransistor 34*b*** turns on a normally inactive triac-controlling circuit within the regulator.

A full-wave bridge rectifier 38 is in series with a gate resistor 40, and the series combination is in parallel with the triac 30 to receive applied alternating voltage from the input terminals 26. The bridge rectifier develops a full-wave rectified direct voltage between a supply conductor 42 and a return conductor 44. As shown at the left side of FIG. 2, a zener diode 46 is in series with a fixed resistor 48 between the supply conductor 42 and the return conductor 44 to maintain the voltage at a further conductor 50 limited to an intermediate value well below that of the supply conductor 42.

The regulator circuit which the bridge rectifier 38 powers when the opto-isolator 34 is on has a timing capacitor 52 charged from a current-source transistor 54. Fixed resistors 56 and 58 apply nominal bias to the base of transistor 54 from the lo-voltage supply conductor 50. The transistor emitter is connected through a further resistor 60 to receive supply voltage from the conductor 50; the connection is through the collector-emitter path of the photo-transistor **34*b*. A feed-forward stage 62 with a differential switch applies the capacitor 52 charge to the gate of a silicon controlled rectifier 64 to trigger the triac 30 into conduction in each half-cycle of the alternating input voltage. The controlled rectifier 64 is in series with a current-limiting resistor 66 between the supply conductor 42 and the return conductor. A resistor 68 provides a low resistance path between the rectifier 64 gate and the return conductor to prevent accidential triggering of the rectifier. In addition, a resistor 70 and a capacitor 71** shunt the controlled rectifier to limit the maximum change of anode voltage, again to protect against accidental triggering.

With further reference to FIG. 2, within the feed-forward stage 62, fixed resistors 72 and 74 form a voltage divider between the bridge rectifier output conductors 42 and 44. The current-carrying path of a programmable unijunction transistor 76 is arranged to conduct current, when conductive, from the capacitor 52 to the gate of the controlled rectifier 64 through a limiting resistor 78. The gate of the programmable transistor is connected to the interconnection of the fixed resistors 72 and 74. With this arrangement, the potential at the transistor 76 gate follows substantially the full-wave rectified voltage output from the bridge 38 and accordingly varies in magnitude with the line voltage applied between the input terminals 26. The potential at the anode, on the other hand, varies with the charge on the timing capacitor 52. The programmable transistor 76 is a unidirectional current-carrying differential-switch device which is normally non-conductive and becomes conductive only when the potential at the anode exceeds the potential at the gate. Other differential switches can be used in lieu of the programmable unijunction transistor, although the latter device is considered preferable for the illustrated circuit. Also within the stage 62, a capacitor 80 is connected between the transistor 76 gate and the lo-voltage conductor 50. The capacitor ensures that the potential at the gate of the programmable transistor is larger than at the anode at the start of each half-cycle of the alternating line voltage, to prevent inadvertent triggering of the unijunction transistor. For this operation, the capacitor 80 has a capacitance far smaller than that of the timing capacitor 52. By way of example, in one embodiment having a timing capacitor 52 of 0.1 microfarad, the capacitor 80 has a value of 680 picofards.

In addition to the feed-forward stage 62, FIG. 2 shows that the regulator has a feedback stage 82 which varies the rate at which transistor 54 charges the timing capacitor 52. The illustrated feedback stage 82 has a full-wave bridge rectifier 84 in series with a current-limiting resistor 86 between the load terminals 28. A voltage sensor provided by a zener diode 88 in series with an opto-isolator 90, which has a light-emitting diode **90*a* input element and a photoconductor 90*b* output element, is connected between the output terminals of the bridge rectifier. The photoconductor 90*b* is connected between the gate of a field effect transistor 92 and the lo-voltage conductor 50. One main terminal of the transistor 92 is connected to the conductor 50 and the other is connected to the base of the current-charging transistor 54. A variable resistor, e.g. potentiometer 94, is also connected between the field effect transistor gate and the return conductor 44**.

The operation of the regulator 14 commences when an alternating line voltage is applied to the terminals 26 and the camera switch 18*b* is closed. When only line voltage is applied but the switch 18*b* is open, the transistors and other four-layer semiconductor devices 34*b*, 54, 64, 76 and 92 are nonconductive. This is because the isolator transistor 34*b* is nonconductive so that transistor 54 is nonconductive and timing capacitor 52 receives no charge. Accordingly, the triac 30 receives no trigger pulses and remains nonconductive. Only a minor current is drawn through the lamp 12 or other load connected between terminals 28, and consequently the zener diode 88 in the feedback stage 82 is nonconductive.

However, when the camera operator operates the exposure control switch 24 (FIG. 1), the camera switch 18*b* automatically closes and delivers current to the light-emitting diode 34*a* in the opto-isolator 34. Electroluminesence from the diode 34*a* activates the phototransistor 34*b* and the resultant conduction therein applies the limited supply voltage at conductor 50 to the capacitor-charging transistor 54. The transistor accordingly conducts and commences charging the timing capacitor 52.

The voltage across the timing capacitor 52 is applied to the anode of the programmable unijunction transistor 76, whereas resistors 72 and 74 apply a portion of the full-wave rectified voltage from the rectifier 38 to the gate of the element. At the start of each half-cycle of the alternating input line voltage, the capacitor charge and hence the voltage at the anode of the programmable transistor are less, relative to the return conductor 44, than the voltage at the gate. This is particularly true due to the rapid initial increase in gate voltage which the capacitor 80 provides. Consquently at the beginning of each half-cycle of the alternating input line voltage, the programmable transistor 76 is nonconductive for an interval termed a delay angle. Under this condition, the controlled rectifier 64 is nonconductive, and the triac 30 is also nonconductive. The load 12 accordingly receives no significant voltage.

After a selected delay angle, the timing capacitor 52 becomes charged to a voltage that exceeds the transistor 76 gate voltage by the gate-anode threshold of that transistor. At this point the transistor 76 switches to a conductive state and there is essentially negligible resistance within the device between the three terminals thereof. The conductive transistor 76 discharges the timing capacitor 52, through the current-limiting resistor 78, and produces a gate current in the controlled rectifier 64 sufficient to trigger that element to become conductive. The resultant drop in resistance through the controlled rectifier 64 draws a relatively large current through the resistor 66, and this in turn draws a relatively large current through the triac gate 32, with the result that the triac 30 is fired to conduct.

The triac conducts for the remainder of the half-cycle of alternating input voltage, and during this conduction angle the triac applies the input line voltage to the load 12. The reversal of the line voltage polarity at the end of this half-cycle automatically turns off the triac 30. But the foregoing charging of capacitor 52 to initiate conduction of unijunction transistor 76 again fires the triac, during the next half-cycle of the line voltage, to conduct in the opposite direction.

The foregoing description of the operation of the regulator with the feed-forward stage 62 assumes that the timing capacitor 52 charges at a rate essentially independent of variations or changes in the input line voltage, due to the essentially fixed voltage which the zener diode 46 maintains at the lo-voltage supply conductor 50. However, the firing point, and hence the duration of the delay angle and conversely the duration of the conduction angle, change in accordance with the amplitude of the input line voltage, due to the application of voltage corresponding to that amplitude to the gate of the programmable transistor 76 by way of resistors 72 and 74. For example, when the line voltage drops from one half-cycle to the next, the capacitor 52 attains the correspondingly reduced voltage at the transistor gate earlier in that half-cycle than in the prior one. The triac consequently is fired earlier in that half-cycle, and hence applies a greater portion of the input voltage to the load 12. The converse operation results when the line voltage increases.

As will now be described with continued reference to FIG. 2, the feedback stage 82 of the regulator controls the rate at which the timing capacitor 52 is charged, in response to the mean square of the voltage developed across the load 12. The bridge rectifier 84 converts alternating voltage across the load terminals 28 to a correspondingly varying direct voltage. This voltage is applied across the series combination of the zener diode 88 and the light-emitting diode 90*a* in the opto-isolator 90. Electroluminesence from the diode 90*a* varies the resistance of the photoconductor 90*b* in the isolator 90. Hence the current in the opto-isolator input diode 90*a* during each conduction angle, when the triac 30 applies voltage across the load 12, produces illumination of the photoconductor 90*b*. But the diode 90*a* receives no significant current during the delay angle of each half-cycle. However, the rise time of the photoconductor 90*b* is relatively short, whereas the decay time is relatively long. The resistance of the photoconductor hence increases relatively rapidly with an increasing current in the diode 90*a*, but the resistance drops only slowly after the diode current diminishes. As a result, the level of photoconductor resistance which the light emitting diode 90*a* establishes during the conduction angle of each half-cycle of input line voltage essentially persists and continues during the ensuing delay angle of the next half-cycle. The overall resistance of the photoconductor 90*b* thus responds, to a substantial extent, to the mean square of the voltage developed across the load terminals 28.

This level of photoconductor 90*b* resistance, together with the resistance level to which the potentiometer 94 is set, controls the conduction in transistor 92 to reduce the charging of capacitor 52 from the nominal level which resistors 56 and 58 set. That is, the resistance through the transistor 92 is in parallel with fixed resistor 56; hence an increase in the transistor 92 conduction decreases transistor 54 conduction, thereby slowing the rate of charge of capacitor 52.

The fact that the feedback stage 82 controls the resistance of the photoconductor 90*b* in accordance with the mean square of the voltage across the load terminals 28 causes the stage 82 to control the charging of timing capacitor 52 in accordance with the frequency of the input line voltage. For example, where the amplitude of the input line voltage remains fixed but the frequency increases, the feed-forward stage 62 tends to apply line voltage to the load for a shorter conduction angle.

Hence the mean square of the voltage developed at the load tends to decrease. The feedback stage stage 82 responds to this condition by increasing the rate at which transistor 54 charges the timing capacitor 52. This increases the conduction angle of the triac operation, with the result that the regulator maintain a constant mean square voltage level across the load terminals 28. In this manner, the combined regulation which the two stages 62 and 82 provide, with the single timing capacitor 52, in controlling the single triac 30, enables the regulator to control the output voltage under variations and fluctuations in both the amplitude and the frequency of the alternating input line voltage.

The commonly assigned patent application Ser. No. 938,768 filed on even date herewith for Electrical Mean Square Voltage Sensor, in the name of K. Kiesel, describes the voltage sensor in the feedback stage 82 in further detail.

The illustrated regulator also incorporates conventional so-called snubber circuit element to protect the triac 30. These include a choke 96 in series with the triac to retard extreme changes in current through it, a pair of capacitors 98*a* and 98*b* in parallel with the triac, and a resistor 100 in parallel with one capacitor 98*b*. The capacitors bypass high transient voltages, and the resistor damps any oscillations. The choke 96 limits high currents which the regulator would otherwise tend to draw from the supply of line voltage under certain malfunctions such as a short circuit within the lamp 12. In addition, a varistor 102 is connected in parallel with the triac to protect both the triac and other portions of the regulator from extreme voltage spikes. The varistor normally has a relatively high resistance and hence has nil effect on the circuit during normal operating voltages, but the varistor resistance drops significantly and nonlinearly for voltages in excess of those normally encountered.

The illustrated regulator circuit also accommodates the relatively large surge of current which a lamp 12 typically tends to draw during the first few cycles after it is turned on and before it heats up. That is, when many lamps are first turned on, the resistance in the lamp is relatively small and the lamp tends to draw a large surge current. After several cycles, however, the lamp heats up and its resistance increases to the normal operating value. The present regulator accommodates these surge currents, by conduction through the triac, without damage. Further, the regulator is free of circuit elements other than the load 12 and the triac 30 (with the choke 96), in the series path between the input terminals 26.

It will thus be seen that the photographic lamp regulator efficiently attains the objects set forth above, among those made apparent from the preceding description. Since those skilled in the art can make certain changes in the above construction without departing from the scope of the invention, it is intended that all matter contained in the above description or shown in the accompanying drawing be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described the invention, that is claimed as new and secured by Letters Patent is:

1. A circuit for regulating an alternating input voltage source of the type subject to relatively wide variations in amplitude and in frequency to provide an energizing current to a load at a select power level, said regulating circuit comprising:

a pair of input terminals for connection to the source of alternating input voltage;

a pair of output terminals for connection to a load;

first switch means in series connection electrically with said output load terminals between said input terminals for switching between a nonconductive state and a conductive state in which said switch means carries current during a portion of each half-cycle of the alternating input voltage;

control means connected with said switch means and actuatable for selectively switching said switch means from its said nonconductive state is its said conductive state;

timing means for actuating said control means to switch said switch means from its said nonconductive state to its said conductive state after an adjustable time interval within each half-cycle of alternating input voltage wherein said timing means includes a timing capacitor and means for charging said timing capacitor;

first regulating means of a feed-forward type in electrical connection with said timing means and with said control means for adjusting said time interval in response to variations in the input voltage wherein said first regulating means includes second switch means connected with said timing capacitor for actuating said control means only in response to a voltage arising across said timing capacitor having a select value relative to the amplitude of the input voltage; and second regulating means of the feedback type in electrical connection with said timing means and with the voltage developed across said output terminals for adjusting said time interval in response to variations in the mean square of the voltage developed across said output terminals.

2. The voltage regulating circuit of claim 1 further comprising an externally-actuated third switch means in electrical connection with said timing means for rendering said timing means inoperative in the absence of an assertive actuating signal, so that said first switch means remains in its said non-conductive state so as not to furnish power to said output terminals in the absence of said assertive actuating signal.

3. The voltage regulating circuit of claim 1, wherein said second switch means includes a seimiconductor switch element having a controllable current path in series between said timing capacitor and said control means and having a gating input thereof connected to receive a voltage responsive to a selected portion of the input voltage amplitude.

4. The voltage regulating circuit of claim 3 further comprising a second capacitor means connected with said gating input of said semiconductor switch element for applying voltage thereto, said second capacitor means having a lesser capacitance value than said timing capacitor.

5. The voltage regulating circuit of claim 1 wherein said second regulating means includes means for detecting the means square of the voltage developed across said output terminals and for controlling the rate at which said capacitor-charging means charges said timing capacitor in response thereto.

6. The voltage regulating circuit of claim 1, wherein:

said first switch means includes a single regulating switch element in series connection with said output terminals between said input terminals, said control means includes a normally nonconductive gate controlled rectifier, and said means for charging said timing capacitor operates to charge said timing capacitor from a substantially fixed level of voltage developed in response to the alternating input voltage.

7. The voltage regulating circuit of claim 6, wherein:

said first regulating means comprises a semiconductor differential switch element having a normally nonconductive current path in series between said timing capacitor and the control gate of said controlled rectifier and having a gating input connected to receive a voltage corresponding to the alternating input voltage, said differential switch element becoming conductive in response to the voltage across said timing capacitor attaining a selected value relative to the voltage at said gating input for triggering said controlled rectifier; and said second regulating means comprises sensor means responsive to the mean square of the voltage developed at said output terminals, and transistor means for controlling the rate at which said capacitor charging means charges said timing capacitor in response to a signal from said sensor means.

8. A lamp regulator circuit for regulating an alternating input voltage source of the type subject to relatively wide variations in amplitude and in frequency to provide an energizing current to a lamp at a select power level, said regulator circuit comprising:

a pair of input terminals for connection to the source of the alternating input voltage;

a pair of output terminals for connection to a lamp;

a semiconductor current-carrying switch means in series electrically with said output terminals between said input terminals, for switching between a nonconductive state and a first conductive state to carry current in a first conduction direction during the first half-cycle of the alternating input voltage, and a second conductive state to carry current in a second conduction direction during a second half-cycle of an alternating input voltage;

rectifier means in parallel electrical connection with said switch means for producing a direct voltage in response to the alternating input voltage;

trigger means for initiating conduction of said switch means;

a timing capacitor;

means for charging said timing capacitor from a substantially fixed voltage developed from said rectifier direct voltage;

differential semiconductor switch means having a normally-open conduction path in series between said timing capacitor and said trigger means and having a gate element for initiating conduction therein connected to receive a voltage proportional to the amplitude of the alternating input voltage;

a feedback detector in electrical connection with the voltage across said output terminals for developing in response thereto a feedback signal; and means for controlling the rate at which said capacitor-charging means charges said timing capacitor in resonse to said feedback signal, wherein said differential switch means controls the timing capacitor voltage at which said trigger means initiates switch means conduction in response to the amplitude of said input voltage, and said feedback detector and control means regulate the rate of capacitor charging in response to the voltage developed at said load terminals.

9. The regulator circuit of claim 8 further comprising capacitor means connected with said differential switch means and with said rectifier means for augmenting the voltage at the gating element of said differential switch means.

* * * * *